US008294347B2

(12) United States Patent
Nakamura et al.

(10) Patent No.: US 8,294,347 B2
(45) Date of Patent: Oct. 23, 2012

(54) SPARK PLUG HAVING SPECIFIC CONFIGURATION OF PACKING AREA

(75) Inventors: Mai Nakamura, Inazawa (JP); Akira Suzuki, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/120,173

(22) PCT Filed: Sep. 18, 2009

(86) PCT No.: PCT/JP2009/066397

§ 371 (c)(1),
(2), (4) Date: Mar. 22, 2011

(87) PCT Pub. No.: WO2010/035717

PCT Pub. Date: Apr. 1, 2010

(65) Prior Publication Data

US 2011/0181168 A1 Jul. 28, 2011

(30) Foreign Application Priority Data

Sep. 24, 2008 (JP) ..... 2008-243699

(51) Int. Cl.
*H01T 13/36* (2006.01)
*H01T 13/02* (2006.01)

(52) U.S. Cl. ..... 313/144; 313/143

(58) Field of Classification Search ..... 313/118, 313/143, 144; 445/7

See application file for complete search history.

(56) References Cited

U.S. PATENT DOCUMENTS

| | | | | |
|---|---|---|---|---|
| 5,688,390 | A | 11/1997 | Yamauchi et al. | |
| 7,443,089 | B2 * | 10/2008 | Hoffman et al. | 313/141 |
| 7,707,985 | B2 * | 5/2010 | Lykowski et al. | 123/169 EL |

FOREIGN PATENT DOCUMENTS

| | | | |
|---|---|---|---|
| JP | 61-039880 | U | 3/1986 |
| JP | 61-054690 | U | 4/1986 |
| JP | 8-193971 | A | 7/1996 |
| JP | 2005-190762 | A | 7/2005 |

* cited by examiner

*Primary Examiner* — Karabi Guharay
(74) *Attorney, Agent, or Firm* — Sughrue Mion, PLLC

(57) ABSTRACT

A spark plug is provided which can ensure gastightness between a metal shell and an insulator while preventing the cracking of the insulator. There is provided a spark plug in which a ledge portion 30 is formed on the metal shell 11 whose inside diameter is reduced gradually towards a front end portion, a step portion 32 is formed on an insulator 12 whose outside diameter is reduced gradually towards the front end portion and which confronts the ledge portion 30, and packing 34 is disposed between the ledge portion 30 and the step portion 32, characterized in that a distance between the ledge portion 30 and the step portion 32 gets narrower as the ledge portion 30 and the step portion 32 extend radially inwards, and in that an angle θ formed by the ledge portion 30 and the step portion 32 is one degree or larger and 10 degrees or smaller.

4 Claims, 9 Drawing Sheets

SPARK PLUG HAVING SPECIFIC CONFIGURATION OF PACKING AREA

TECHNICAL FIELD

The present invention relates to a spark plug for use in an internal combustion engine.

BACKGROUND ART

In a spark plug for use in an internal combustion engine, a ground electrode is welded to a combustion chamber side front end portion of a metal shell which holds an insulating member (an insulator) in which a central electrode is inserted, so that a free end portion of the ground electrode is allowed to confront the front end portion of the center electrode so as to form a spark discharge gap. Then, an electric spark is discharged between the center electrode and the ground electrode, which ignites an air/fuel mixture exposed between both the electrodes to thereby form a flame kernel.

In assembling a metal shell and an insulator into a spark plug, a front end portion of the insulator is inserted into the metal shell from a rear end side towards a front end side of the metal shell, and an opening portion at the rear end side of the metal shell is crimped towards the insulator side (radially inwards of the metal shell). Then, in order to ensure gastightness between the metal shell and the insulator, an annular metallic packing is loaded between the metal shell and the insulator as a seal member (refer to Patent Document 1, for example).

FIG. 8 shows a seal portion of a spark plug described in Patent Document 1. As is shown in FIG. 8, a ledge portion 202 is formed on an inner wall of a metal shell 200 which is inclined by an inside diameter being reduced gradually towards a front end portion thereof, and a step portion 206 is formed on an outer wall of an insulator 204 which is inclined by an outside diameter being reduced gradually towards a front end portion thereof and which confronts the ledge portion 202 of the metal shell 200. In addition, an iron packing 208 is loaded between the ledge portion 202 and the step portion 206 as a seal member.

RELATED ART DOCUMENT

Patent Document

Patent Document 1: JP-A-2005-190762

SUMMARY OF THE INVENTION

Problem that the Invention is to Solve

However, in assembling the insulator 204 into the metal shell 200, when an opening portion at a rear end side of the metal shell 200 is crimped strongly to increase a residual stress generated in the packing 208 in order to increase gastightness, the packing 208 is deformed so excessively that an inside diameter portion of the packing 208 is squeezed out inwards from the ledge portion 202 of the metal shell 200 (a portion A) as is shown in FIG. 9, leading to a fear that the portion so squeezed out presses a nose portion 210 of the insulator 204, generating a squeeze crack. Then, if a crack is generated in the insulator 204, there is caused a fear of misfire (engine stop due to combustion failure).

In addition, when a rising amount of an outside diameter portion of the packing 208, which is an amount by which the outside diameter portion of the packing 208 is squeezed out from a rear end portion of the ledge portion 202 towards a rear end side (a portion B), is increased, the outside diameter portion of the packing 208 enters between the metal shell 200 and the insulator 204, leading to a fear that a press crack is generated.

The invention has been made in view of the problems that have been described, and an object thereof is to provide a spark plug which can ensure gastightness between a metal shell and an insulator while preventing the cracking of the insulator.

Means for Solving the Problem

The aforesaid object of the invention will be attained by the following configurations.

(1) A spark plug comprising:

a cylindrical metal shell;

a cylindrical insulator which is fitted in the metal shell and includes a front end portion exposed from a front end portion of the metal shell;

a center electrode which is disposed inside the insulator so that a front end portion of the center electrode is exposed from the front end portion of the insulator;

a ground electrode which is connected to the metal shell at one end portion of the ground electrode and is disposed so as to confront the front end portion of the center electrode at the other end portion of the ground electrode, so as to form a spark discharge gap between the other end portion of the ground electrode and the front end portion of the center electrode; and a packing which is mounted between the metal shell and the insulator for establishing a gastight seal between the metal shell and the insulator, wherein the metal shell is formed with a ledge portion having inside diameter reduced gradually towards the front end portion so as to form a packing engagement plane, the insulator is formed with a step portion having outside diameter reduced gradually towards the front end portion so as to form a packing engagement plane which confronts the ledge portion, and the packing is disposed between the ledge portion and the step portion, wherein a distance between the ledge portion and the step portion gets narrower as the ledge portion and the step portion extend radially inwards, and wherein an angle formed by the ledge portion and the step portion is one degree or larger and ten degrees or smaller.

(2) The spark plug according to (1), wherein a gas seal portion is formed on an outer circumferential surface of the metal shell along a circumferential direction and a distance from the gas seal portion to a front end face of the metal shell is 25 mm or larger.

(3) The spark plug according to (1) or (2), wherein a hardness of the ledge portion of the metal shell is larger than a hardness of the packing.

(4) The spark plug according to (1) to (3), wherein a zinc plating is applied to at least surfaces of the ledge portion of the metal shell and the packing.

According to the configuration described under (1), the distance between the ledge portion of the metal shell and the step portion is such as to get narrower as the ledge portion and the step portion extend radially inwards, and the angle formed by the ledge portion and the step portion is one degree or larger and ten degrees or smaller, whereby stress acting on the packing is concentrated inwards and the residual stress generated in the packing can be maintained at a sufficiently large level while suppressing an excessive deformation of the packing. Consequently, the squeezed out deformation amount and rising deformation amount of the pocking can be suppressed while ensuring the gastightness. Note that in the event of the angle being smaller than one degree, the deformation suppressing effect of the packing is small, which causes a fear that an amount by which an inside diameter portion of the packing is squeezed out further inwards than a smallest diameter portion of the ledge portion of the metal shell (a squeezed out deformation amount) is increased. In contrast, in the event of the angle exceeding ten degrees, there is caused a fear that an amount by which an outside diameter portion of the packing is squeezed out further rearwards to a rear end side than a rear end of the step portion of the insulator (a rising deformation amount) is increased, which is not preferred.

As is described in the configuration set forth under (2), the invention is particularly effective in a so-called long reach spark plug in which a distance from the gas seal portion to the front end face of the metal shell of the spark plug is 25 mm or larger. Namely, with a spark plug in which the distance is 25 mm or larger, since the gastightness is reduced due to a difference in thermal expansion between the metal shell and the insulator when the spark plug is heated, the packing needs to be deformed so that the packing is allowed to hold a larger residual stress. According to the configuration set forth under (2) above, the packing is allowed to hold the large residual stress while suppressing sufficiently the squeezed out deformation amount of the inside diameter portion of the packing and the rising deformation amount of the outside diameter portion of the packing.

According to the configuration set forth under (3) above, since the hardness of the ledge portion of the metal shell is larger than the hardness of the packing, the packing is deformed along the surface of the ledge portion of the metal shell in an ensured fashion, and hence, there is caused no such situation that the angle between the ledge portion of the metal shell and the step portion of the insulator changes.

According to the configuration set forth under (4) above, the zinc plating is applied to at least the surfaces of the ledge portion of the metal shell and the packing and the friction coefficient between the zinc-plated layers is large, whereby the sliding deformation of the packing can be suppressed. Consequently, the gastightness can be increased by suppressing the deformation of the packing itself.

Advantage of the Invention

According to the invention, the squeezed out deformation of the inside diameter portion of the packing and the rising deformation of the outside diameter portion thereof can be suppressed which would otherwise induce a crack in the insulator, and the residual stress generated in the packing can be maintained at the sufficiently large level, thereby making it possible to obtain an ensured gastightness.

BEST MODE FOR CARRYING OUT THE INVENTION

Hereinafter, preferred embodiments of spark plugs according to the invention will be described by reference to the drawings.

Figure 1:
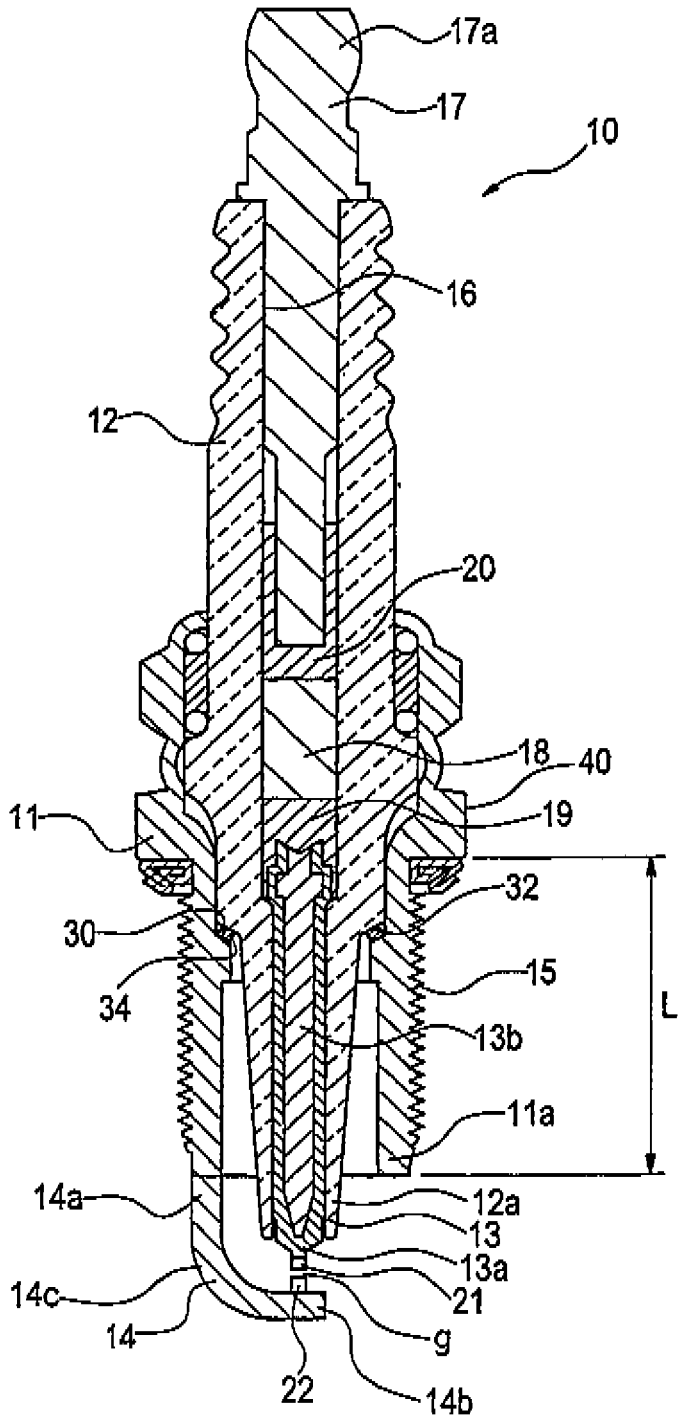
FIG. 1 is sectional view of a spark plug according to the invention.
Figure 2:
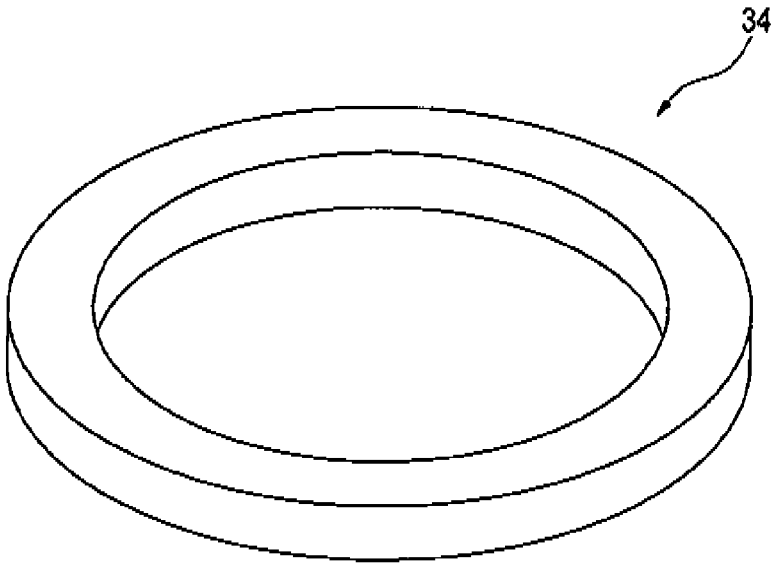
FIG. 2 is a perspective view of a packing.
Figure 3:
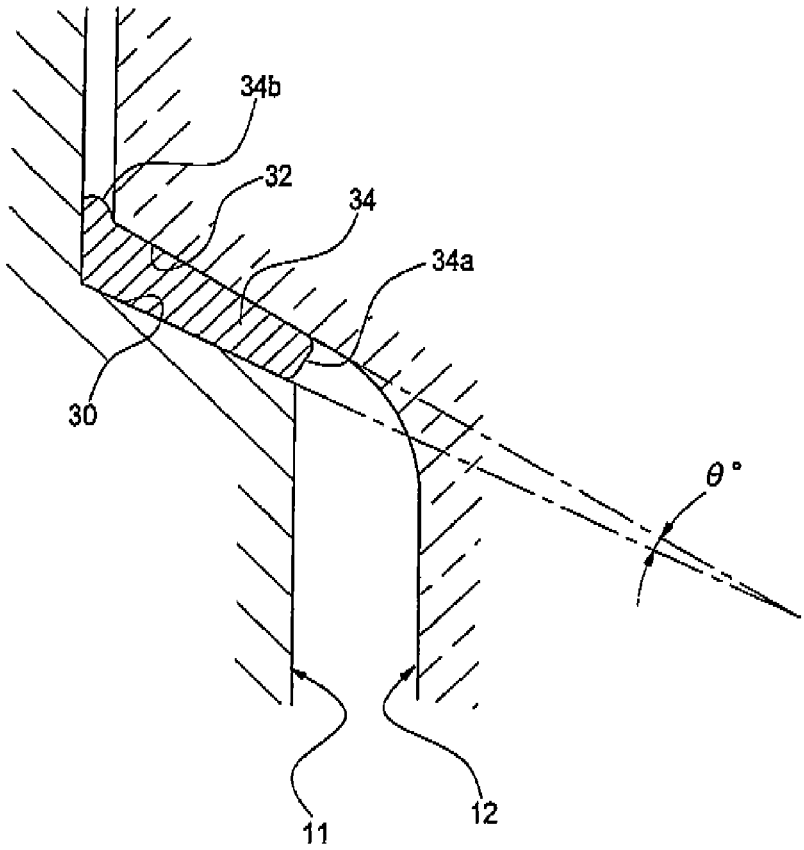
FIG. 3 is an enlarged view of a seal portion of the spark plug in FIG. 1.

FIG. 1 is a sectional view of a spark plug according to the invention, FIG. 2 is a perspective view of a packing, and FIG. 3 is an enlarged view of a seal portion of the spark plug in FIG. 1.

As is shown in FIG. 1, a spark plug 10 of this embodiment mainly includes a cylindrical metal shell 11, a cylindrical insulator 12 which is fitted in the metal shell 11 and whose front end portion 12*a* is exposed from a front end portion 11*a* of the metal shell 11, a center electrode 13 which is disposed in the insulator 12 so that a front end portion 13*a* thereof is exposed from the front end portion 12*a* of the insulator 12, and a ground electrode 14 which is connected to the front end portion 11*a* of the metal shell 11 at one end portion and is disposed to confront the front end portion 13*a* of the center electrode 13 at the other end portion.

Note that in the following description, a side where the ground electrode 14 is disposed in an axial direction of the center electrode 13 will be referred to as a "front side" and an opposite side to the front side will be referred to as a "rear end side."

The metal shell 11 is formed of carbon steel or the like, and a zinc plating is applied to a surface thereof as required. A mounting thread portion 15 is formed circumferentially on an outer circumferential surface of the metal shell 11 for use in mounting the spark plug 10 in a cylinder head of an internal combustion engine, for example. In addition, a metallic terminal 17 is inserted to be fixed in a rear end side (upper in the figure) end portion of a through hole 16 formed axially in the insulator 12 which is made up of a calcined member of ceramics such as alumina in such a state that a front end portion 17*a* is exposed therefrom. The center electrode 13 is inserted to be fixed in a front side (lower in the figure) end portion of the through hole 16 in such a state that a front end portion 13*a* is exposed therefrom. A core 13*b* made of copper is provided in an interior of the center electrode 13.

In addition, a resistor 18 is disposed at an intermediate portion between the metallic terminal 17 and the center electrode 3 within the through hole 16, and conductive glass seal layers 19, 20 are disposed at both axial end portions of the resistor 18. Namely, the center electrode 13 and the metallic terminal 17 are electrically connected together via the resistor 18 and the conductive glass seal layers 19, 20. These conductive glass seal layers 19, 20 and the resistor 18 form a conductive connection layer.

Note that the resistor 18 may be omitted so that the metallic terminal 17 and the center electrode 13 are joined together via a single conductive glass seal layer.

In addition, a ledge portion 30 whose inside diameter is reduced gradually towards the front side is formed on an inner wall of the metal shell 11. Additionally, a step portion 32 whose outside diameter is reduced towards the front side is formed on an outer wall of the insulator 12 which confronts the step portion 30 of the metal shell 11. An annular iron packing 34 shown in FIG. 2 is loaded between the ledge portion 30 and the step portion 32. A zinc plating is applied to a surface of the packing 34 as required.

When the opening portion at the rear end side of the metal shell 11 is crimped radially inwards towards the insulator 12, by the insulator 12 being pressed towards the ledge portion 30 of the metal shell 11, the packing 34 is also held by the ledge portion 30 of the metal shell 11 and the step portion 32 of the insulator 12 to thereby be deformed, and the deformed packing 34 comes to close a gap between the ledge portion 30 and the step portion 32 in a gastight fashion.

Namely, a gas seal portion 40 is formed at a rear end side of the thread portion 15 of the metal shell 11 so as to project radially outwards. A distance L from the gas seal portion 40 to a front end face of the metal shell 11 is 25 mm or larger in this embodiment.

The center electrode 13 is formed of a Ni alloy such as Inconel (a trade name) which has superior thermal resistance and corrosion resistance into a cylindrical shape. A cylindrical center electrode side noble metal tip 21, which is made of an alloy which contains iridium as a main constituent, for example, is secured to the front end portion 13*a* of the center electrode 13 by laser welding or the like.

The ground electrode 14 is formed of a Ni alloy which has superior thermal resistance and corrosion resistance into a prism-like shape. A proximal portion 14*a* of the ground electrode 14 is fixed to the front side end portion of the metal shell 11 by welding. The ground electrode 14 has a bent portion 14*c* at an intermediate portion along the length thereof so as to be bent into a substantially L-shape so that a distal end portion (the other end portion) 14*b* thereof confronts the center electrode 13. A cylindrical ground electrode side noble metal tip 22, which is made of an alloy which contains platinum as a main constituent thereof, for example, is secured to a position on the ground electrode 14 which confronts the center electrode side noble metal tip 21 by laser welding or the like.

By this configuration, a spark discharge gap g is defined between the center electrode side noble metal tip 21 and the ground electrode side noble metal tip 22. A distance of the spark discharge gap g is set to be on the order of about 0.9 mm, for example. Then, by applying a high voltage between the ground electrode 14 (the ground electrode side noble metal tip 22) and the center electrode 13 (the center electrode side noble metal tip 21), an electric spark is discharged in the spark discharge gap g, whereby the spark plug 10 according to the invention functions as an ignition source of the engine.

As is shown in FIG. 3, the ledge portion 30 and the step portion 32 confront each other not in parallel or in a slightly inclined fashion. In this embodiment, a distance between the ledge portion 30 and the step portion 32 is such as to get narrower as the ledge portion 30 and the step portion extend radially inwards, and an angle θ made by the ledge portion 30 and the step portion 32 is set to be one degree or larger and 10 degrees or smaller.

Here, the angle θ formed by the ledge portion 30 and the step portion 32 can be obtained by measuring an angle formed by an imaginary line extended from the ledge portion 30 and an imaginary line extended from the step portion 32 on an imaginary plane containing a plane obtained as if by cutting the spark plug 10 along a center line thereof, for example.

In addition, the narrowing of the distance between the ledge portion 30 and the step portion 32 means that an acute angle formed by the center line of the spark plug 10 and the imaginary line extended from the ledge portion 30 is larger than an acute angle formed by the center line of the spark plug 10 and the imaginary line extended from the step portion 32 on the imaginary plane.

Figure 4:
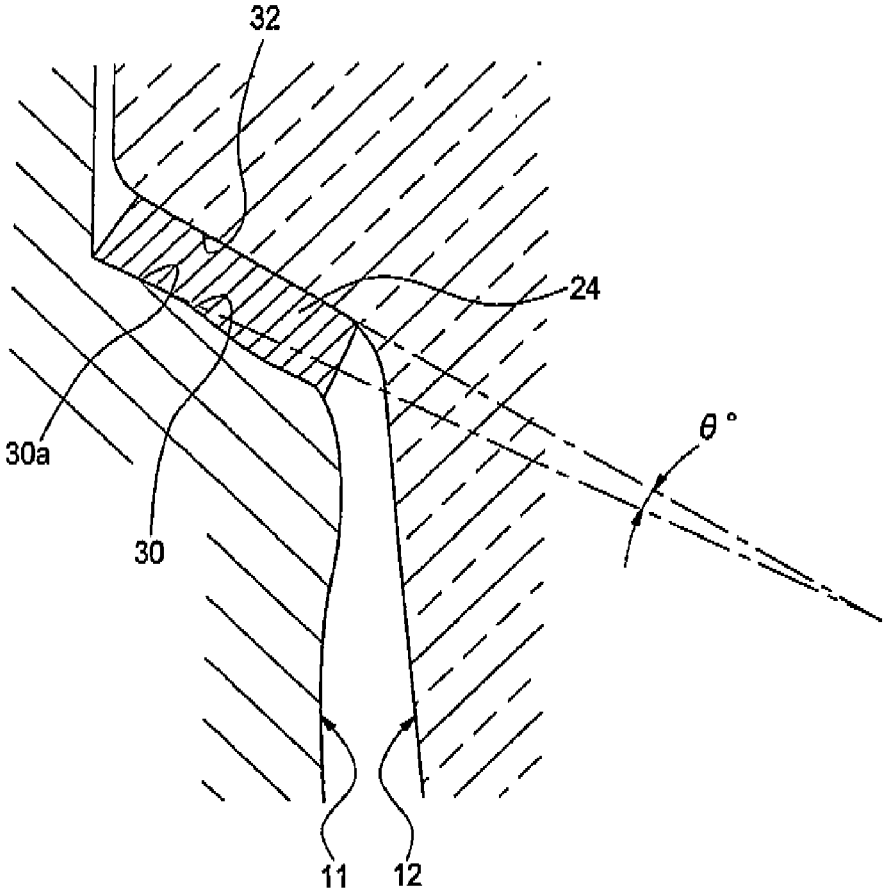
FIG. 4 is an enlarged view of a modified example of a seal portion of the spark plug in FIG. 1.

Note that in the event that the ledge portion 30 is not flat over the whole area thereof due to being deformed as is shown in FIG. 4, an angle θ formed by an imaginary line extended from a flat portion 30*a* of the ledge portion 30 and the imaginary line extended from the step portion 32 is set to be one degree or larger and 10 degrees or smaller.

By setting the angle θ formed by the ledge portion 30 and the step portion 32 to one degree or larger and 10 degrees or smaller, an amount by which a packing inside diameter portion 34*a* is squeezed out further inwards than a smallest diameter portion of the ledge portion 30 (a squeezed-out deformation amount) when the packing 34 is deformed by crimping the rear end side opening portion of the metal shell 11 can be suppressed. In addition, a rising deformation amount by which a packing outside diameter portion 34*b* enters deep into a gap defined between the metal shell 11 and a portion of the insulator 12 which lies further rearwards towards the rear end side than the step portion 32 when the packing 34 is deformed by crimping the rear end side opening portion of the metal shell 11 can be suppressed.

It is considered that the reason that the squeezed-out deformation amount and rising deformation amount can be so suppressed is that although an axial force is exerted on the packing 34 when the insulator 12 is pressed towards the ledge portion 30 of the metal shell 11, by inclining the ledge portion 30 and the step portion 32 at the angle of one degree or larger and 10 degrees or smaller, a stress exerted on an inside diameter portion side of the packing 34 can be increased, whereby a residual stress generated in the packing 34 can be increased to a sufficiently large level while suppressing an excessive deformation of the packing 34.

Consequently, the squeezed-out deformation amount of the packing inside diameter portion 34*a* and the rising deformation amount of the packing outside diameter portion 34*b* can be suppressed, whereby highly reliable gastightness can be obtained while preventing the occurrence of a failure such as a crack which would otherwise be produced by the insulator 12 being pressed by the deformed portion resulting from the squeezed-out deformation and the deformed portion resulting from the rising deformation. In particular, in a long reach spark plug in which a length L from a gas seal portion 40 to a front end face of a metal shell 11 is 25 mm or larger, although there is a fear that the gastightness of a packing 34 is reduced, by applying the aforesaid configuration thereto, an ensured gastightness can be obtained.

Note that for proper deformation of the packing 34, a harness of the metal shell 11 is preferably larger than a hardness of the packing. By making the hardness of the metal shell larger than the hardness of the packing 34, not only is the packing 34 deformed properly when it is crimped, but also the deformation of the ledge portion 30 of the metal shell 11 is prevented.

In the event that a zinc plating is applied to a surface of the metal shell 11, a packing 34 is preferably used to a surface of which a zinc plating is also applied. As this occurs, an excessive deformation of the packing 34 is suppressed by a strong frictional force acting between the zinc plated layers of the metal shell 11 and the packing 34 when the packing 34 is deformed.

Thus, as has been described heretofore, according to the spark plug 10 of the invention, the residual stress generated in the packing 34 can be increased to the sufficiently large level while suppressing the squeezed-out deformation amount and the rising deformation amount of the packing 34, whereby a high gastightness can be obtained between the metal shell 11 and the insulator 12 while preventing the cracking of the insulator 12.

EXAMPLES

Examples of the invention that is configured as has been described above will be described.

Note that the spark plug 10 described in the embodiment was used in evaluation tests made in the following examples.

Example 1

While the angle θ formed by the ledge portion 30 of the metal shell 11 and the step portion 32 of the insulator 12 was changed, a gastightness test was carried out to ISO11565 to measure a squeezed-out amount of the packing 34 when the packing 34 was crimped until there was no gas leakage from an interior of the spark plug. Here, the angle formed by the step portion 32 of the insulator 12 and a direction at right angles to the axial direction was fixed to 30 degrees. The results of the gastightness test carried out are shown in FIG. 5.

Figure 5:
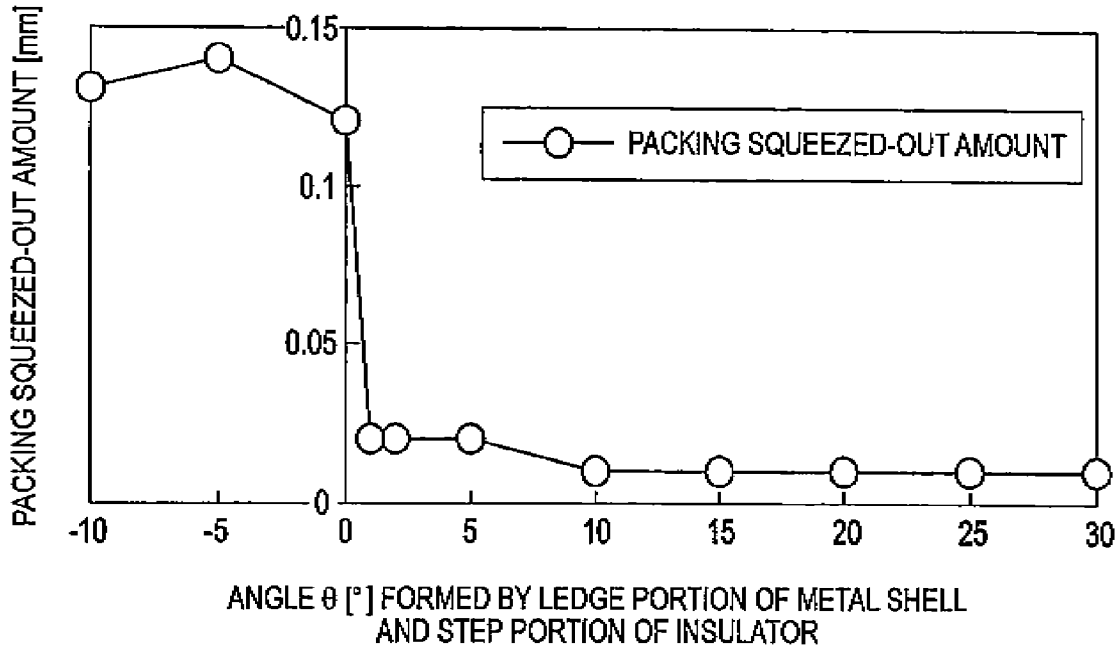
FIG. 5 is a graph showing the results of a test in Example 1.

As is obvious from a graph shown in FIG. 5, with the angle θ being 0 degree or smaller, the squeezed-out amount became larger than 0.1 mm. This squeezed-out amount is a deformation amount which would call for a fear that a squeeze crack is induced in the insulator 12. In contrast to this, with the angle θ being one degree or larger, the squeezed-out amount was suppressed to 0.02 mm or smaller. This squeezed-out amount is not a deformation value which will induce no squeeze crack in the insulator 12.

It is seen from the facts described above that with the angle θ being one degree or larger which is formed by the ledge portion 30 of the metal shell 11 and the step portion 32 of the insulator 12, the squeezed-out amount of the packing 34 is suppressed to the permissible level while maintaining the proper gastightness.

Example 2

While the angle θ formed by the ledge portion 30 of the metal shell 11 and the step portion 32 of the insulator 12 was changed, a gastightness test was carried out to ISO11565 to measure a squeezed-out amount of the packing 34 when the packing 34 was crimped until there was no gas leakage from an interior of the spark plug. Here, the angle formed by the step portion 32 of the insulator 12 and a direction at right angles to the axial direction was fixed to 30 degrees. The results of the gastightness test carried out are shown in FIG. 6.

Figure 6:
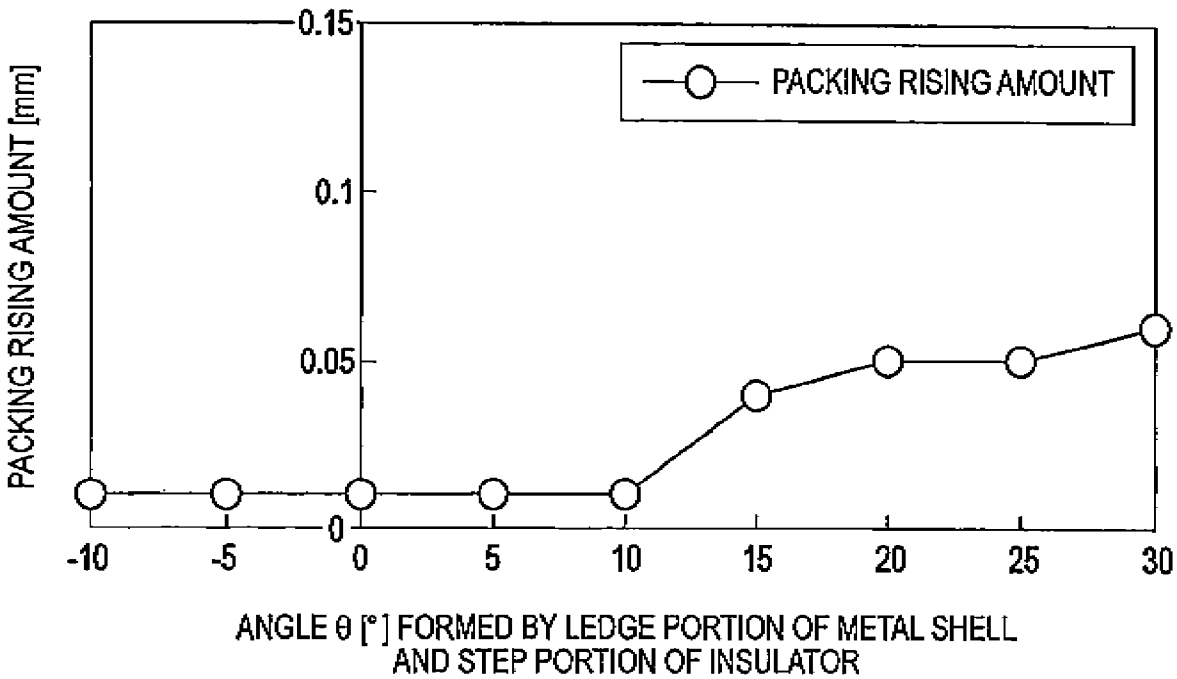
FIG. 6 is a graph showing the results of a test in Example 2.

As is obvious from a graph shown in FIG. 6, with the angle θ being 10 degree or smaller, the rising amount is suppressed to 0.01 mm or smaller. This rising amount is not a deformation amount which will induce a press crack in the insulator 12. In contrast to this, with the angle θ being one 15 degree or larger, the rising amount became on the order of 0.05 mm. This rising amount is a deformation value which would call for a fear that a press crack is induced in the insulator 12.

It is seen from the facts described above that with the angle θ being 10 degrees or smaller which is formed by the ledge portion 30 of the metal shell 11 and the step portion 32 of the insulator 12, the rising amount of the packing 34 is suppressed to the permissible level.

Further, it is seen from the result of Example 1 and the result of Example 2 that with the angle θ being one degree or larger and 10 degrees or smaller which is formed by the ledge portion 30 of the metal shell 11 and the step portion 32 of the insulator 12, both the squeezed-out amount and rising amount of the packing 34 are suppressed to the permissible levels.

Example 3

While the angle θ formed by the ledge portion 30 of the metal shell 11 and the step portion 32 of the insulator 12 was changed to 0 degree and five degrees, a gastightness test was carried out to ISO11565 to measure a squeezed-out amount of the packing 34 and a leakage amount of gas from the interior of the spark plug by use of a long reach spark plug in which the length L from the gas seal portion 40 to the front end face of the metal shell 11 is 25 mm or larger as the spark plug 10. As to the leakage amount, a leakage amount of gas from an interior of a sample spark plug in which the angle θ=0 degree, an iron packing is used and the squeezed-out amount becomes 0 mm is referred to as 1, and resulting data from other sample spark plugs are represented in ratios to the reference leakage amount. The results of the gastightness test are shown in FIG. 7.

Figure 7:
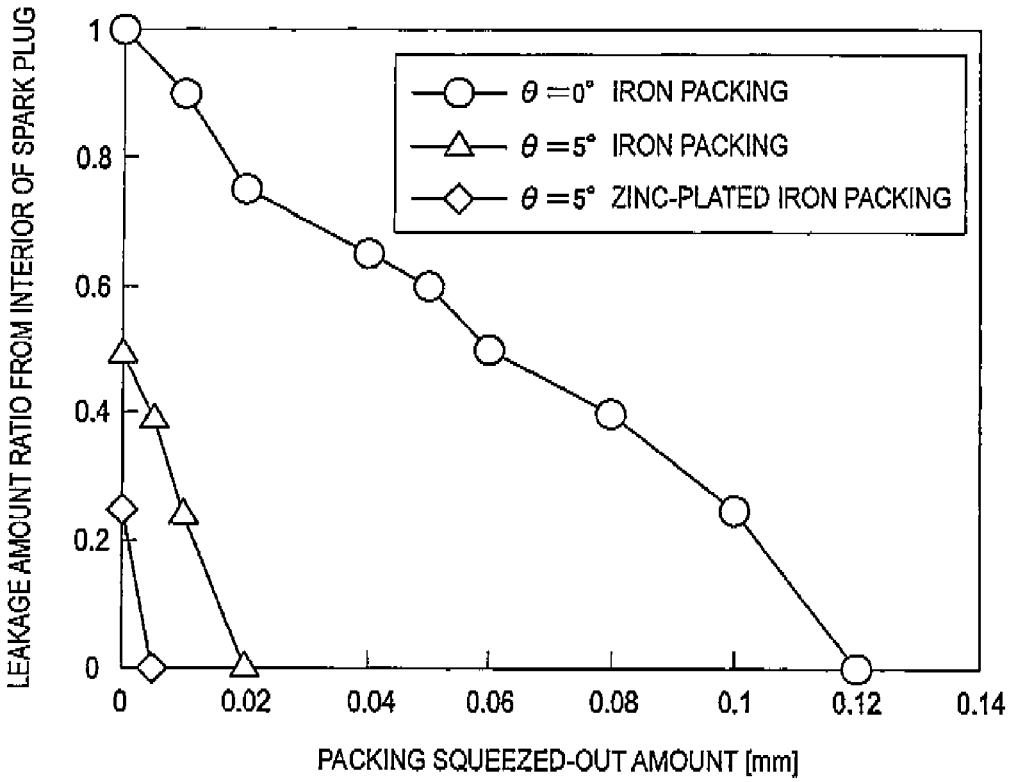
FIG. 7 is a graph showing the results of tests in Examples 3, 4.
Figure 8:
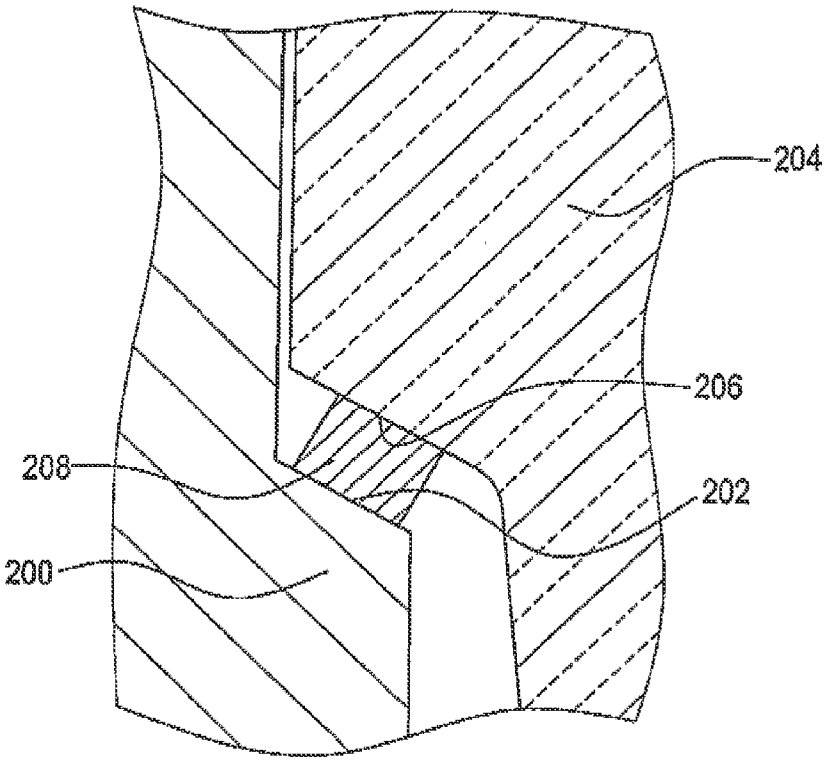
FIG. 8 PRIOR ART
FIG. 8 is an enlarged view of a seal portion of a conventional spark plug.
Figure 9:
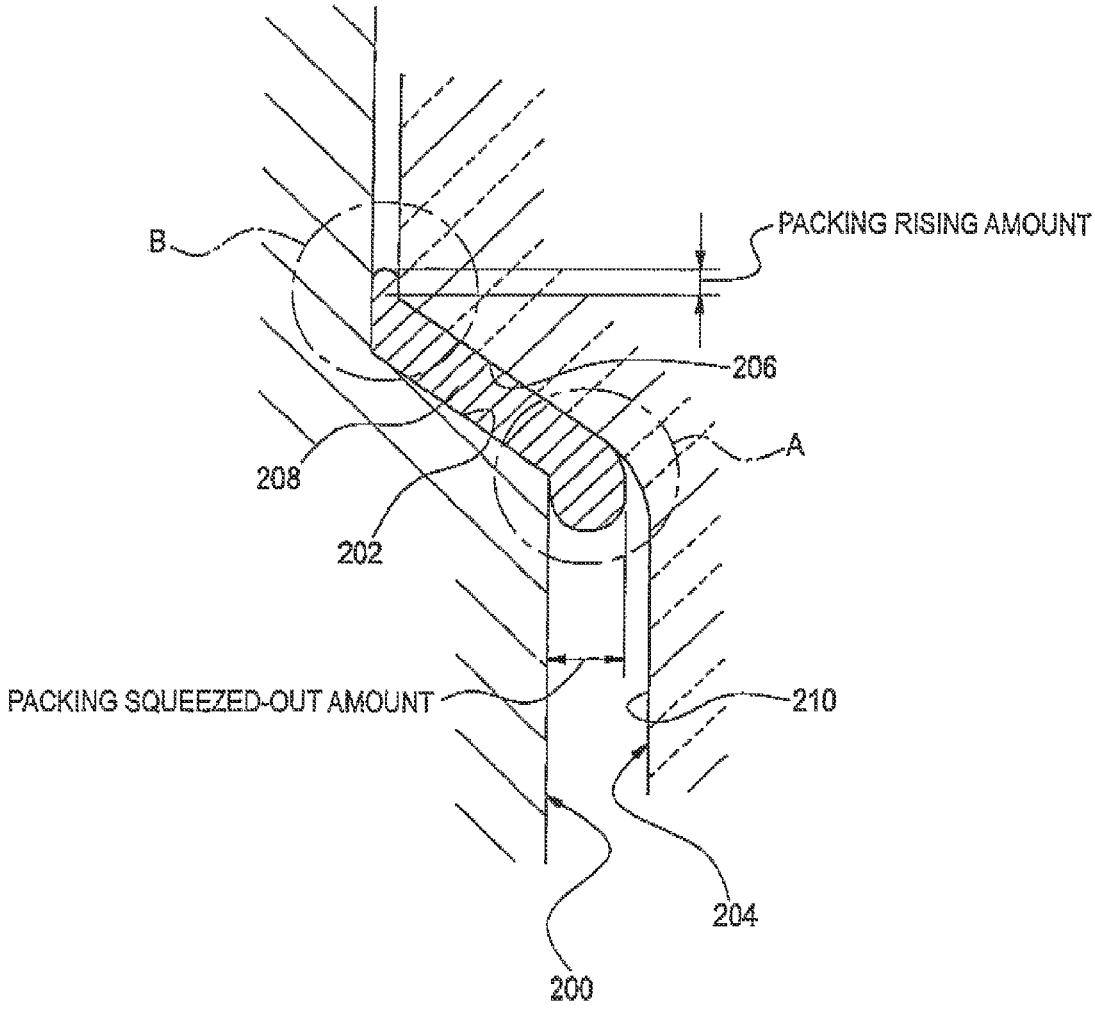
FIG. 9 PRIOR ART
FIG. 9 is an enlarged view of a seal portion of the conventional spark plug when a packing is deformed.

As is obvious from a graph shown in FIG. 7, it is seen that when the rear end side opening portions of the metal shells of the sample spark plugs are crimped to deform the packings 34 installed therein so as to obtain the same gastightness (ratio of gas leakage amounts), the squeezed-out amount of the packing 34 is smaller with the spark plug in which the angle θ is five degrees than with the spark plug in which the angle θ is 0 degree. For example, with the same leakage amount ratio, the data of the spark club in which the angle θ is five degrees are situated further leftwards than the data of the spark club in which the angle θ is 0 degree at all times, which means the squeezed-amount of the former spark plug is smaller than that of the latter spark plug.

It is seen from these facts that in the long reach spark plug in which the length L from the gas seal portion 40 to the front end face of the metal shell 11 is 25 mm or larger, the squeezed-out amount of the packing 34 is reduced by the ledge portion 30 of the metal shell 11 and the step portion 32 of the insulator 12 confronting each other not in parallel or in a slightly inclined fashion.

Example 4

Using as the metal shell 11 a metal shell to a surface of which a zinc plating was applied and using as the packing 34 two types of iron packings; a packing 34 to a surface of which a zinc plating was applied and a packing 34 to a surface of which no zinc plating was applied, a squeezed-out amount of the packing 34 and a leakage amount were measured. The results are shown in FIG. 7.

As is obvious from FIG. 7, it is seen that when the rear end side opening portions of the metal shells of the sample spark plugs are crimped to deform the packings 34 installed therein so as to obtain the same gastightness (ratio of gas leakage amounts), the squeezed-out amount of the packing 34 to which the zinc plating was applied is smaller than that of the packing 34 to which the zinc plating was not applied. For example, with the same leakage amount ratio, the data of the packing 34 to which the zinc plating was applied are situated further leftwards than the data of the packing 34 to which the zinc plating was not applied at all times, which means the squeezed-amount of the former packing is smaller than that of the latter packing.

It is seen from these facts that in the event of the zinc plating being applied to the surface of the metal shell 11, the squeezed-out amount of the packing 34 is reduced by the application of the zinc plating also to the surface of the packing 34. Consequently, it is seen that with the metal shell 11 to which the zinc plating is applied, it is preferable to use the packing 34 to which the zinc plating is applied.

Note that the invention is not limited to the embodiment and can be modified or improved as required. For example, while the embodiment is effective particularly for the long reach spark plug in which the length L from the gas seal portion 40 to the front end of the metal shell 11 is 25 mm or larger, the invention is also effective even though the invention is applied to a spark plug in which the length L from the gas seal portion 40 to the front end face of the metal shell 11 is smaller than 25 mm.

While the invention has been described in detail and by reference to the specific embodiment, it is obvious to those skilled in the art to which the invention pertains that various alterations and modifications can be made to the embodiment without departing from the spirit and scope of the invention.

The subject patent application is based on Japanese Patent Application (No. 2008-243699) filed on Sep. 24, 2008, the contents of which are to be incorporated herein by reference.

DESCRIPTION OF REFERENCE NUMERALS AND CHARACTER

10 spark plug;
11 metal shell;
11*a* front end portion of metal shell;
12 insulator;
12*a* front end portion of insulator;
13 center electrode;
13*a* front end portion of center electrode;
14 ground electrode;
14*b* distal end portion of ground electrode;
22 contact electrode side noble metal tip;
30 ledge portion;
32 step portion;
34*a* packing inside diameter portion;
34*b* packing outside diameter portion;
40: gas seal portion;
g: spark discharge gap.

The invention claimed is:

1. A spark plug comprising:

a cylindrical metal shell;

a cylindrical insulator which is fitted in the metal shell and includes a front end portion exposed from a front end portion of the metal shell;

a center electrode which is disposed inside the insulator so that a front end portion of the center electrode is exposed from the front end portion of the insulator;

a ground electrode which is connected to the metal shell at one end portion of the ground electrode and is disposed so as to confront the front end portion of the center electrode at the other end portion of the ground electrode, so as to form a spark discharge gap between the other end portion of the ground electrode and the front end portion of the center electrode; and a packing which is mounted between the metal shell and the insulator for establishing a gastight seal between the metal shell and the insulator, wherein the metal shell is formed with a ledge portion having inside diameter reduced gradually towards the front end portion so as to form a packing engagement plane, the insulator is formed with a step portion having outside diameter reduced gradually towards the front end portion so as to form a packing engagement plane which confronts the ledge portion, and the packing is disposed between the ledge portion and the step portion, wherein a distance between the ledge portion and the step portion gets narrower as the ledge portion and the step portion extend radially inwards, and wherein an angle formed by the ledge portion and the step portion is one degree or larger and ten degrees or smaller.

2. The spark plug according to claim 1, wherein a gas seal portion is formed on an outer circumferential surface of the metal shell along a circumferential direction and a distance from the gas seal portion to a front end face of the metal shell is 25 mm or larger.

3. The spark plug according to claim 1, wherein a hardness of the ledge portion of the metal shell is larger than a hardness of the packing.

4. The spark plug according to claim 1, wherein a zinc plating is applied to at least surfaces of the ledge portion of the metal shell and the packing.

* * * * *